US007267852B1

(12) United States Patent
Rosado et al.

(10) Patent No.: US 7,267,852 B1
(45) Date of Patent: Sep. 11, 2007

(54) COLLAPSIBLE ARTIFICIAL CHRISTMAS TREE

(76) Inventors: Wanda E. Rosado, 1215 SE. 46th La., Apt. H, Cape Coral, FL (US) 33904; Luis Leon Perez, 4131 Santa Barbara Blvd., Cape Coral, FL (US) 33914

( * ) Notice: Subject to any disclaimer, the term of this patent is extended or adjusted under 35 U.S.C. 154(b) by 0 days.

(21) Appl. No.: 11/416,702

(22) Filed: May 3, 2006

(51) Int. Cl.
*A47G 33/06* (2006.01)
*A41G 1/00* (2006.01)

(52) U.S. Cl. ..... 428/20

(58) Field of Classification Search ..... 428/8, 428/18, 19, 20
See application file for complete search history.

(56) References Cited

U.S. PATENT DOCUMENTS 843,712 A * 2/1907 Straub ..... 211/197
1,590,220 A * 6/1926 Wurts ..... 211/197
3,374,798 A * 3/1968 Samuelson ..... 135/33.7
3,846,213 A * 11/1974 Thiemann ..... 428/9
4,451,510 A 5/1984 Boisvert et al.
4,734,301 A * 3/1988 McKinney ..... 428/8
4,847,123 A 7/1989 Armstead et al.
5,106,661 A 4/1992 Pitts, Sr.
5,413,825 A 5/1995 Chaikin
6,162,515 A * 12/2000 Hill ..... 428/20

* cited by examiner

*Primary Examiner*—John J. Zimmerman
*Assistant Examiner*—Aaron Austin

(57) ABSTRACT

A collapsible artificial Christmas tree that opens and retracts like an umbrella has an elongate trunk with a branch hinge connected to a trunk. A tree branch is rotatably connected to the branch hinge. A slide ring is slidably connected to the trunk. A branch lift rod is rotatably connected to the slide ring. The branch lift rod is rotatably connected to the tree branch for moving the tree branch when the slide ring slidably moves on the trunk.

20 Claims, 5 Drawing Sheets

COLLAPSIBLE ARTIFICIAL CHRISTMAS TREE

BACKGROUND OF THE INVENTION

1. Field of the Invention

The present embodiment of the invention relates to a collapsible artificial Christmas tree for use in connection with artificial trees. The collapsible artificial Christmas tree has particular utility in connection with an artificial Christmas tree capable of automatic collapsement and deployment by a set of spring driven branches wherein each set of branches has a conical support element for creating a nestable structure.

2. Description of the Prior Art

Collapsible artificial Christmas trees are desirable for space savings. A need was felt for a Christmas tree capable of collapsement and deployment by the set of spring driven branches, wherein each set of branches has the conical support element for creating a nestable structure.

The use of artificial trees is known in the prior art. For example, U.S. Pat. No. 4,847,123 to Armstead et al. discloses a pop-up artificial Christmas tree has an elongated trunk which is held vertical by a stand. A plurality of stationary sleeves are affixed to the trunk and a guide sleeve is disposed on the trunk to slide proximate to and remote from an adjacent stationary sleeve. Pivotally connected to depend from each sleeve are a plurality of limbs that bear integrally attached branches. When the guide sleeve is pushed into proximity with the lowermost stationary sleeve, the limbs of the stationary sleeves and the guide sleeves pivot to substantially horizontal orientations. The guide sleeve is held into proximity with the lowermost stationary sleeve by a pin extending through the trunk, and an extension with branches of decreasing length from bottom to top may be attached to extend from the top of the trunk to effect a conical configuration of a natural tree. The pop-up artificial Christmas tree may be collapsed to a storage state when the guide sleeve is slid away from the lowermost stationary sleeve, the extension taken from the top, and the collapsed tree and extension may be stored in a bag that also serves as an under-the-tree spread. From the storage state, the pop-up artificial Christmas tree may be popped up again to the posture of a natural tree like one might pop up an umbrella. However, the Armstead et al. '123 patent does not have a spring driven set of nestable branches.

Further, U.S. Pat. No. 5,106,661 to Pitts, Sr. discloses a compressible artificial tree includes a vertically extending trunk mounted on a stand or base. Branch units formed of branches radially extending from rings are slidably mounted on the trunk and are held in spaced relation by springs extending therebetween. The branch units are vertically compressible toward one another onto a lower portion of the trunk. Once held in the compressed state by a storage pin, the upper portion of the trunk and the tree top are removed to enable the compressed artificial tree to be stored. However, the Pitts, Sr. '661 patent does not have a spring driven set of nestable branches.

Further still, U.S. Pat. No. 5,413,825 to Chaikin discloses a collapsible artificial Christmas tree has a center pole erectable on a base, a cap that fits over the top of the pole, and a spiral coil of split plastic tubing, which extends upward to form a conical shape when the cap is placed on the pole. The split plastic tubing carries an electrical wire inside the tubing with sockets and bulbs extending outwardly between edges of the tubing at intervals. Stringers in the form of plastic line are connected to the base and cap as well as to the split tubing to cause the spiral coil to assume the proper shape. In addition to serving as a tree stand, the base and its cover provide a storage box in which the spiral coil and other parts of the tree are stored. The use of metal parts in proximity to electrical wires is avoided. However, the Chaikin '825 patent does not have a spring driven set of nestable branches.

Similarly, U.S. Pat. No. 4,451,510 to Boisvert et al. discloses an automatic artificial Christmas tree using an improved one-piece plastic molded branch holding ring and spacer combination for use with twisted wire stem branches or other suitable metal wire branches without the need to resort to individual branch attaching connectors. According to the disclosed method of assembly, the branches used have a straight wire stem. The stem of each branch is first inserted into a branch receiving radial slot of a branch holder. Its free end is then raised upwardly from the horizontal position to the vertical or beyond to form a hook for pivotally connecting the branch to the holder. However, the Boisvert et al. '510 patent does not have a spring driven set of nestable branches.

Lastly, U.S. Pat. Des. No. 256,223 to Byun discloses a collapsible artificial Christmas tree. However, the Byun '223 patent does not have a spring driven set of nestable branches.

While the above-described devices fulfill their respective, particular objectives and requirements, the aforementioned patents do not describe a collapsible artificial Christmas tree that allows an artificial Christmas tree capable of automatic collapsement and deployment by a set of spring driven branches wherein each set of branches has a conical support element for creating a nestable structure. The Armstead et al. '123, Pitts, Sr. '661, Chaikin '825, Boisvert et al. '510 and Byun '223 patents make no provision for a spring driven set of nestable branches.

Therefore, a need exists for a new and improved collapsible artificial Christmas tree which can be used for an artificial Christmas tree capable of automatic collapsement and deployment by a set of spring driven branches wherein each set of branches has a conical support element for creating a nestable structure. In this regard, the present embodiment of the invention substantially fulfills this need.

In this respect, the collapsible artificial Christmas tree according to the present embodiment of the invention substantially departs from the conventional concepts and designs of the prior art, and in doing so provides an apparatus primarily developed for the purpose of an artificial Christmas tree capable of automatic collapsement and deployment by a set of spring driven branches wherein each set of branches has a conical support element for creating a nestable structure.

SUMMARY OF THE INVENTION

In view of the foregoing disadvantages inherent in the known types of artificial trees now present in the prior art, the present embodiment of the invention provides an improved collapsible artificial Christmas tree, and overcomes the above-mentioned disadvantages and drawbacks of the prior art. As such, the general purpose of the present embodiment of the invention, which will be described subsequently in greater detail, is to provide a new and improved collapsible artificial Christmas tree and method which has all the advantages of the prior art mentioned heretofore and many novel features that result in a collapsible artificial Christmas tree which is not anticipated, rendered obvious, suggested, or even implied by the prior art, either alone or in any combination thereof.

To attain this, the present embodiment of the invention essentially comprises a branch hinge connected to a trunk. A tree branch is rotatably connected to the branch hinge. A slide ring is slidably connected to the trunk. A branch lift rod is rotatably connected to the slide ring. The branch lift rod is rotatably connected to the tree branch for moving the tree branch when the slide ring slidably moves on the trunk.

There has thus been outlined, rather broadly, the more important features of the embodiment of the invention in order that the detailed description thereof that follows may be better understood and in order that the present contribution to the art may be better appreciated.

The present embodiment of the invention may also include a trunk base, a tree stand, a locking pin, a spring, a handle and a connecting rod. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved collapsible artificial Christmas tree that has all of the advantages of the prior art artificial trees and none of the disadvantages.

It is another object of the present embodiment of the invention to provide a new and improved collapsible artificial Christmas tree that may be easily and efficiently manufactured and marketed.

An even further object of the present embodiment of the invention is to provide a new and improved collapsible artificial Christmas tree that has a low cost of manufacture with regard to both materials and labor, and which accordingly is then susceptible of low prices of sale to the consuming public, thereby making such collapsible artificial Christmas tree economically available to the buying public.

Still another object of the present embodiment of the invention is to provide a new collapsible artificial Christmas tree that provides in the apparatuses and methods of the prior art some of the advantages thereof, while simultaneously overcoming some of the disadvantages normally associated therewith.

Lastly, it is an object of the present embodiment of the invention is to provide a collapsible artificial Christmas tree for an artificial Christmas tree capable of automatic collapsement and deployment by a set of spring driven branches wherein each set of branches has a conical support element for creating a nestable structure.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
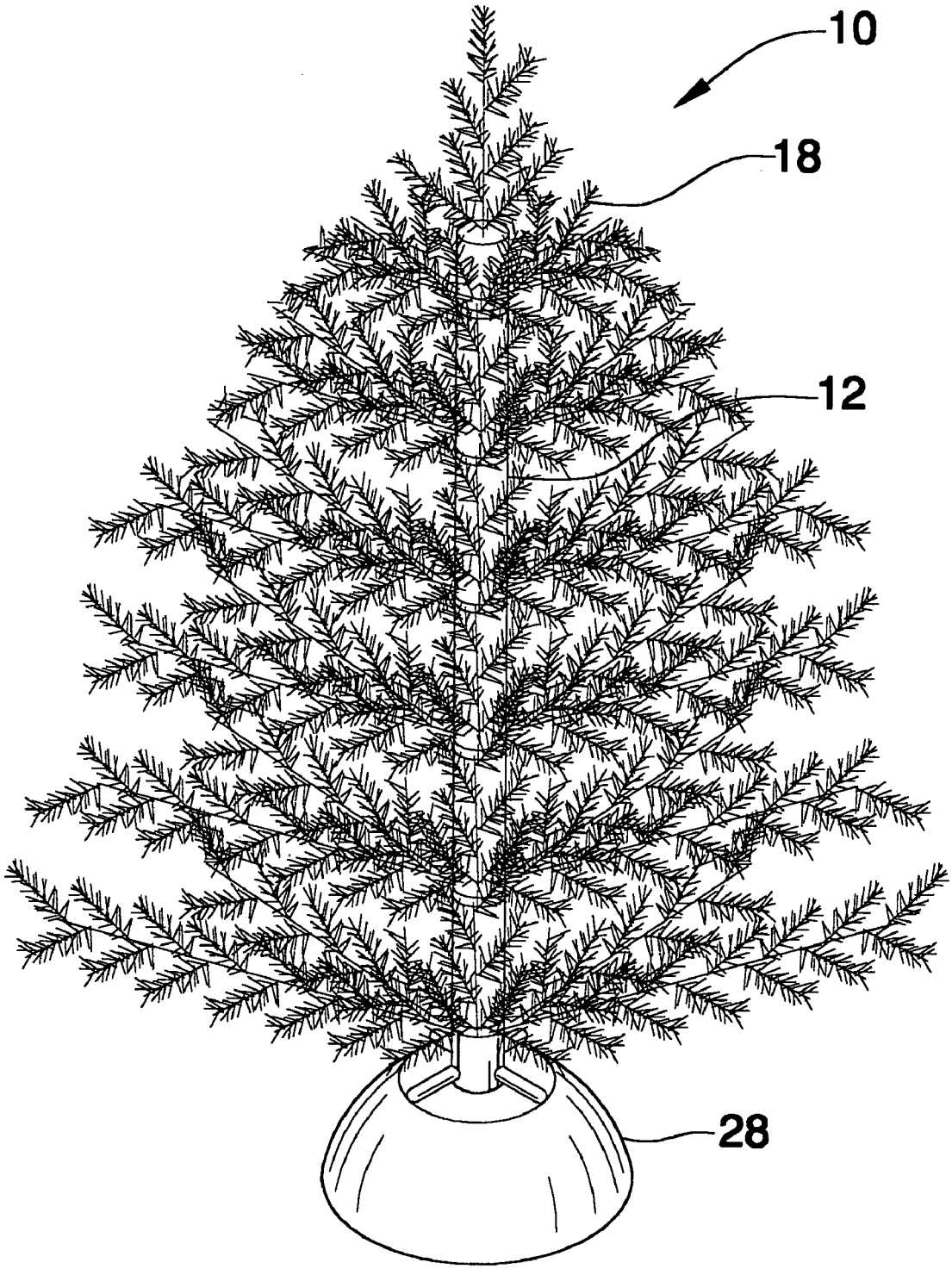
FIG. 1 is a top perspective view of the preferred embodiment of the collapsible artificial Christmas tree constructed in accordance with the principles of the present invention.

Referring now to the drawings, and particularly to FIGS. 1-6, a preferred embodiment of the collapsible artificial Christmas tree of the present invention is shown and generally designated by the reference numeral 10.

In FIG. 1, a new and improved collapsible artificial Christmas tree 10 of the present invention for an artificial Christmas tree capable of automatic collapsement and deployment by a set of spring driven branches wherein each set of branches has a conical support element for creating a nestable structure is illustrated and will be described. More particularly, the collapsible artificial Christmas tree 10 has an elongate trunk 12. A tree stand 28 is connected to the trunk 12.

Figure 2:
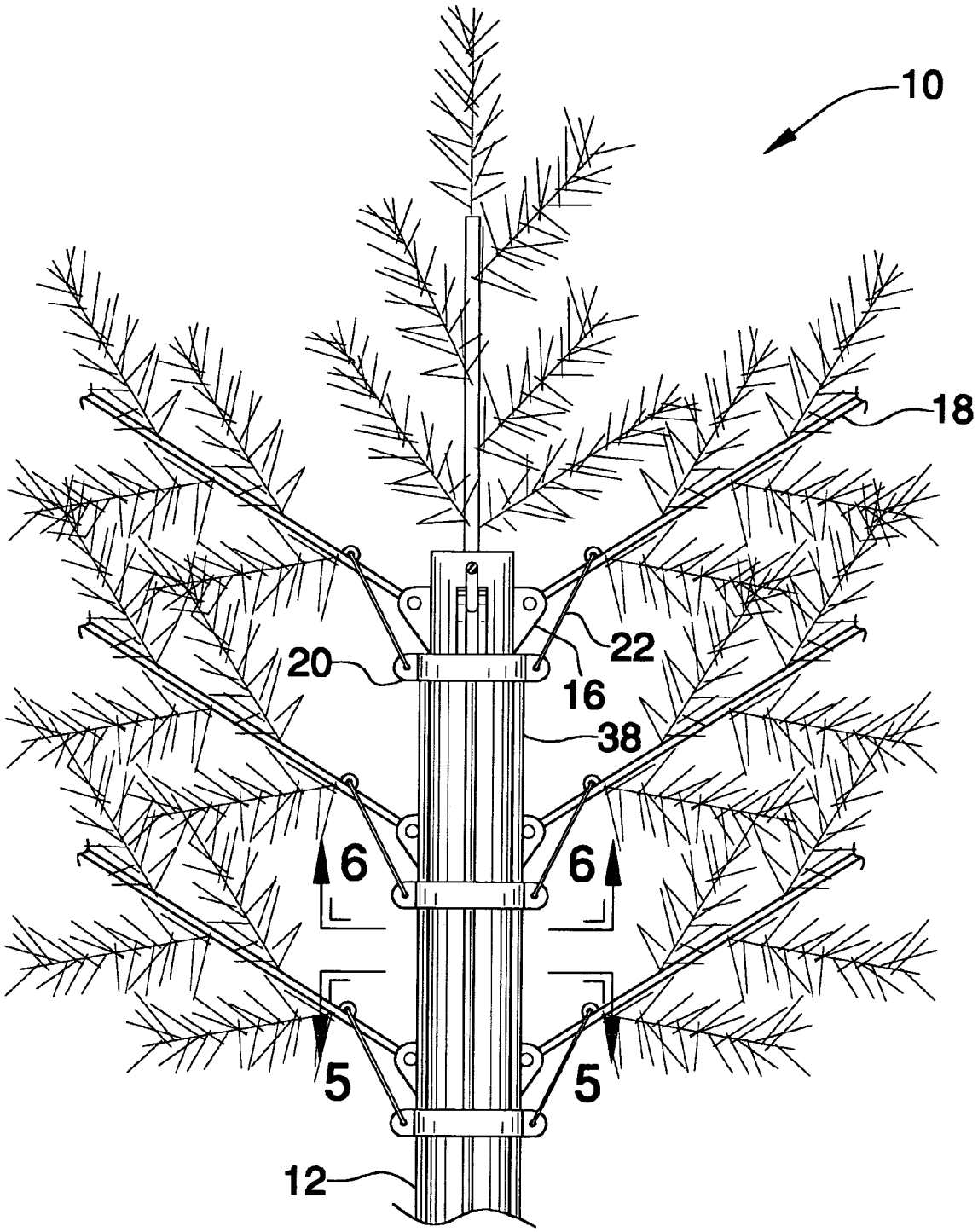
FIG. 2 is a side view of the collapsible artificial Christmas tree of the present embodiment of the invention.

In FIG. 2, the collapsible artificial Christmas tree 10 is illustrated and will be described. More particularly, the collapsible artificial Christmas tree 10 has the elongate trunk 12. The trunk 12 is tubular in the present example. A branch hinge 16 is connected to the trunk 12. A tree branch 18 is rotatably connected to the branch hinge 16. The tree branch 18 is substantially shaped as the evergreen tree branch. A slide ring 20 is slidably connected to the trunk 12. A branch lift rod 22 is rotatably connected to the slide ring 20. The branch lift rod 22 is rotatably connected to the tree branch 18 for moving the tree branch 18 when the slide ring 20 slidably moves on the trunk 12. A connecting rod 38 is connected to the slide ring 20.

Figure 3:
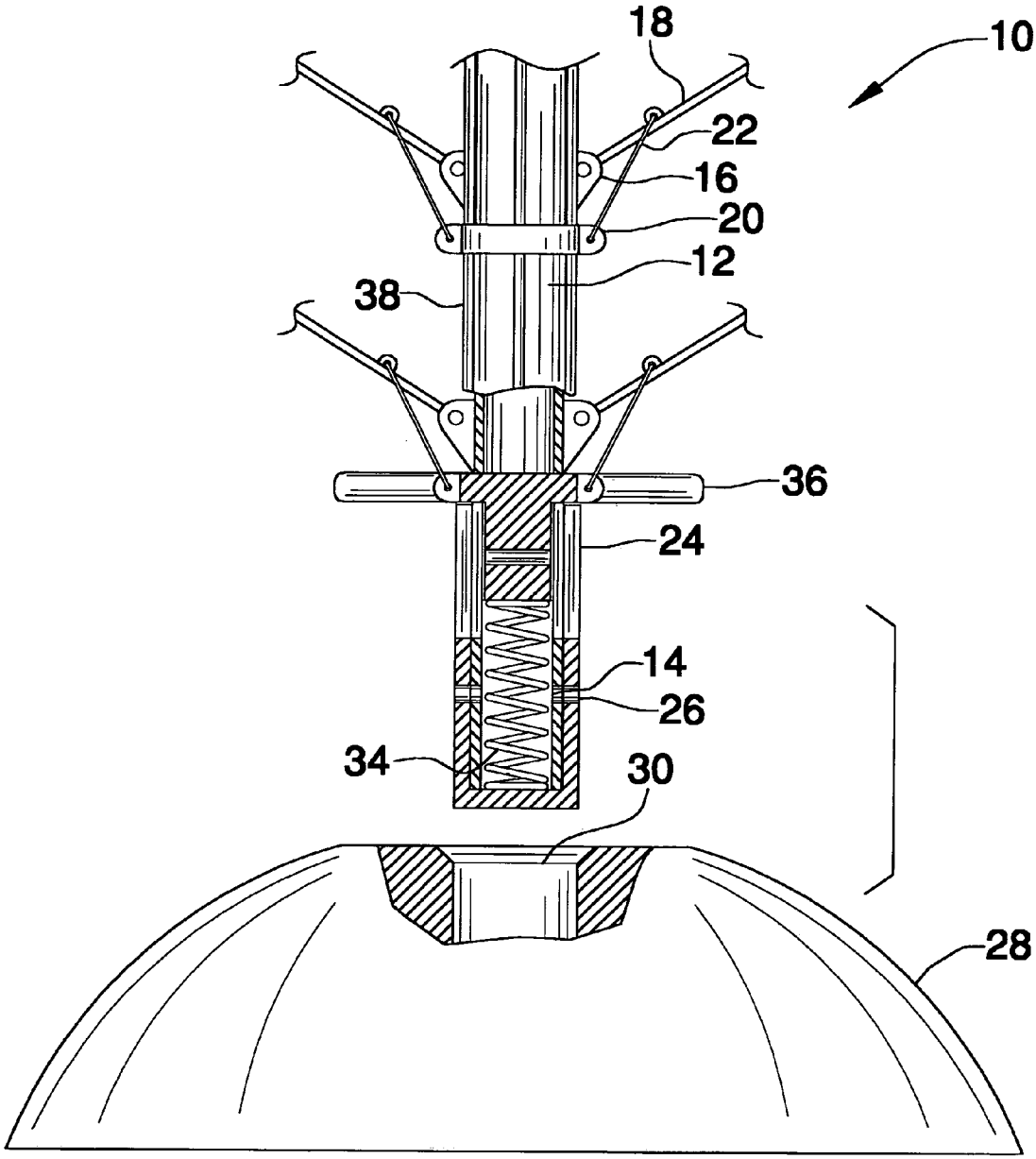
FIG. 3 is a section view of the collapsible artificial Christmas tree of the present embodiment of the invention.

In FIG. 3, the collapsible artificial Christmas tree 10 is illustrated and will be described. More particularly, the collapsible artificial Christmas tree 10 has the elongate trunk 12 that has a trunk locking hole 14 therethrough. The branch hinge 16 is connected to the trunk 12. The tree branch 18 is rotatably connected to the branch hinge 16. The tree branch 18 is substantially shaped as the evergreen tree branch. The slide ring 20 is slidably connected to the trunk 12. The branch lift rod 22 is rotatably connected to the slide ring 20. The branch lift rod 22 is rotatably connected to the tree branch 18 for moving the tree branch 18 when the slide ring 20 slidably moves on the trunk 12. A trunk base 24 is connected to the trunk 12. The trunk base 24 has a trunk base locking hole 26 therethrough. The tree stand 28 has a tree stand bore 30 which is complementary to the trunk base 24. A spring 34 is connected to the trunk 12. A handle 36 is connected to the branch lift rod 22. The connecting rod 38 is connected to the slide ring 20.

Figure 4:
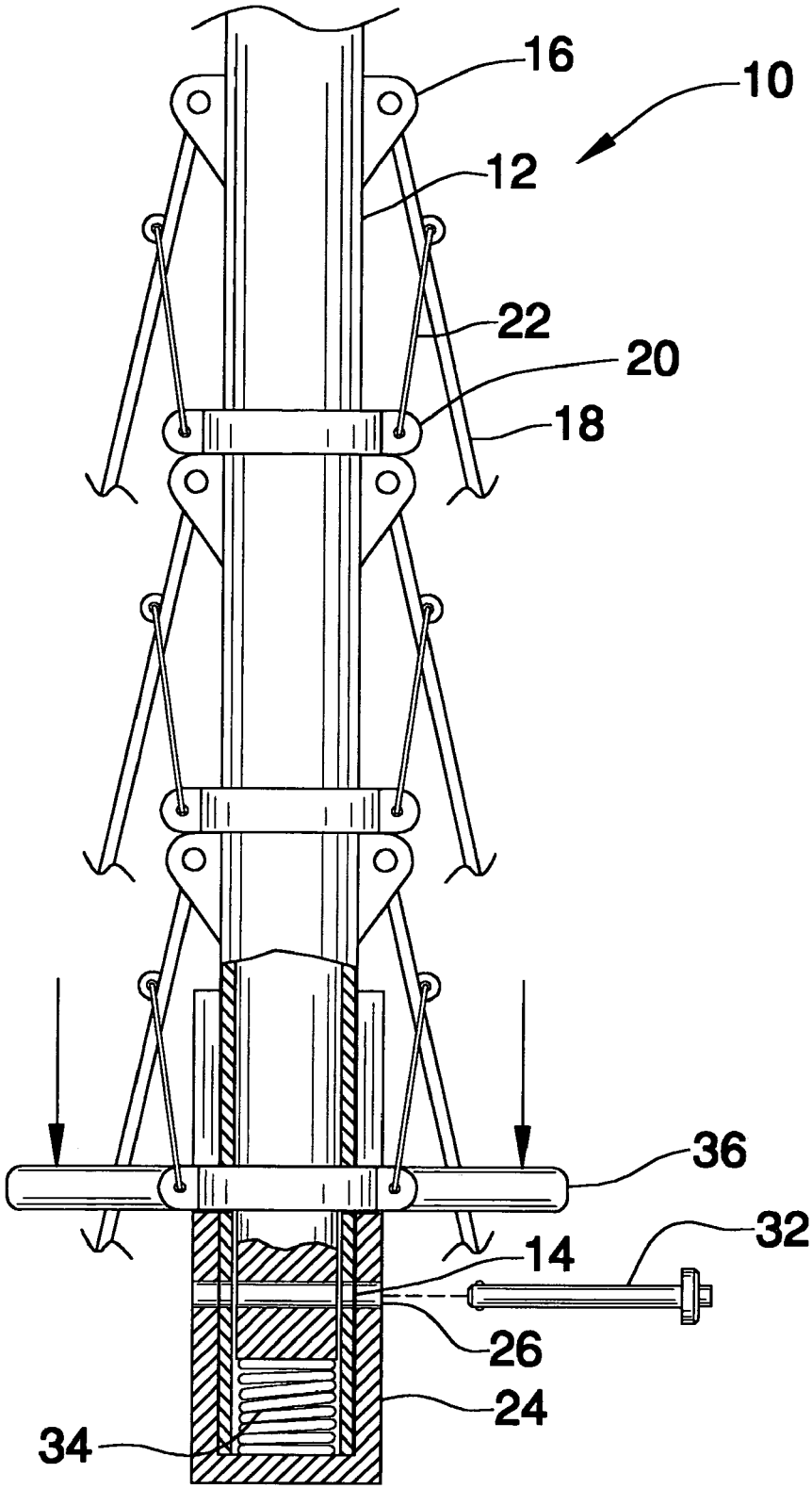
FIG. 4 is a section view of the collapsible artificial Christmas tree of the present embodiment of the invention.

In FIG. 4, the collapsible artificial Christmas tree 10 is illustrated and will be described. More particularly, the collapsible artificial Christmas tree 10 has the elongate trunk 12 that has the trunk locking hole 14 therethrough. The branch hinge 16 is connected to the trunk 12. The tree branch 18 is rotatably connected to the branch hinge 16. The slide ring 20 is slidably connected to the trunk 12. The branch lift rod 22 is rotatably connected to the slide ring 20. The branch lift rod 22 is rotatably connected to the tree branch 18 for moving the tree branch 18 when the slide ring 20 slidably moves on the trunk 12. The trunk base 24 is connected to the trunk 12. The trunk base 24 has the trunk base locking hole 26 therethrough. A locking pin 32 is disposable within the trunk locking hole 14. The locking pin 32 is disposable within the trunk base locking hole 26. The spring 34 is connected to the trunk 12. The handle 36 is connected to the branch lift rod 22. The connecting rod 38 is connected to the slide ring 20.

Figure 5:
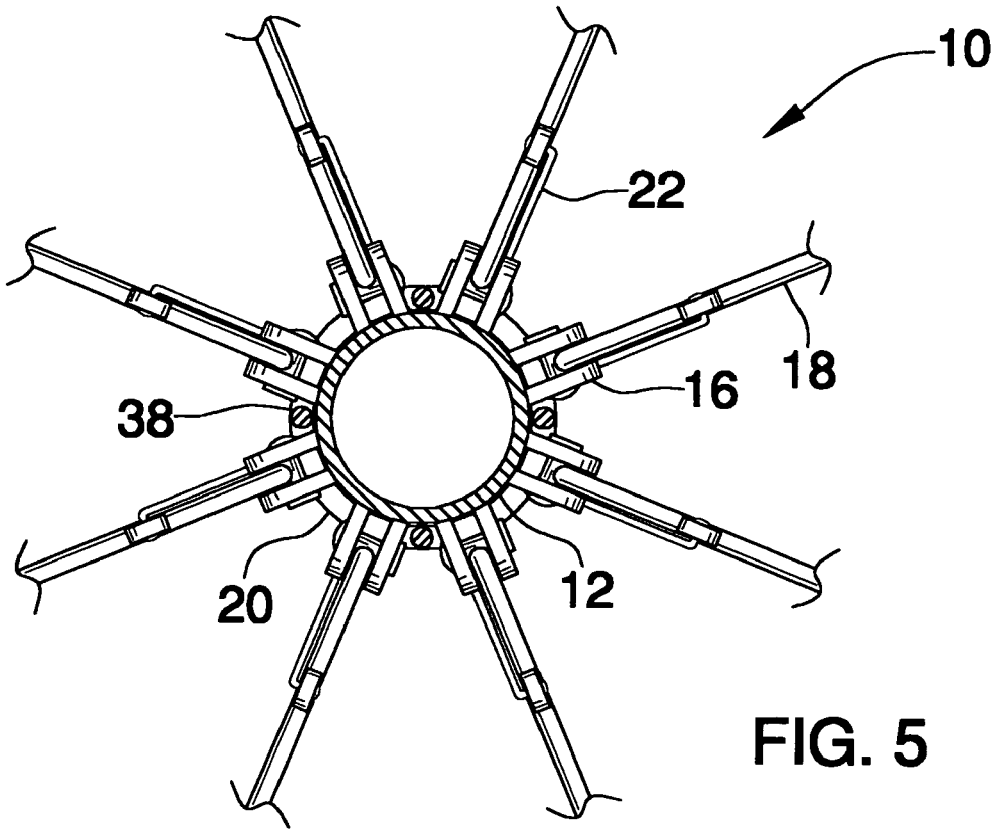
FIG. 5 is a section 5-5 view of FIG. 2 of the collapsible artificial Christmas tree of the present embodiment of the invention.

In FIG. 5, the collapsible artificial Christmas tree 10 is illustrated and will be described. More particularly, the collapsible artificial Christmas tree 10 has the tubular trunk 12 in the present example. The branch hinge 16 is connected to the trunk 12. The slide ring 20 is slidably connected to the trunk 12. The branch lift rod 22 is rotatably connected to the slide ring 20. The branch lift rod 22 is rotatably connected to the tree branch 18 for moving the tree branch 18 when the slide ring 20 slidably moves on the trunk 12.

Figure 6:
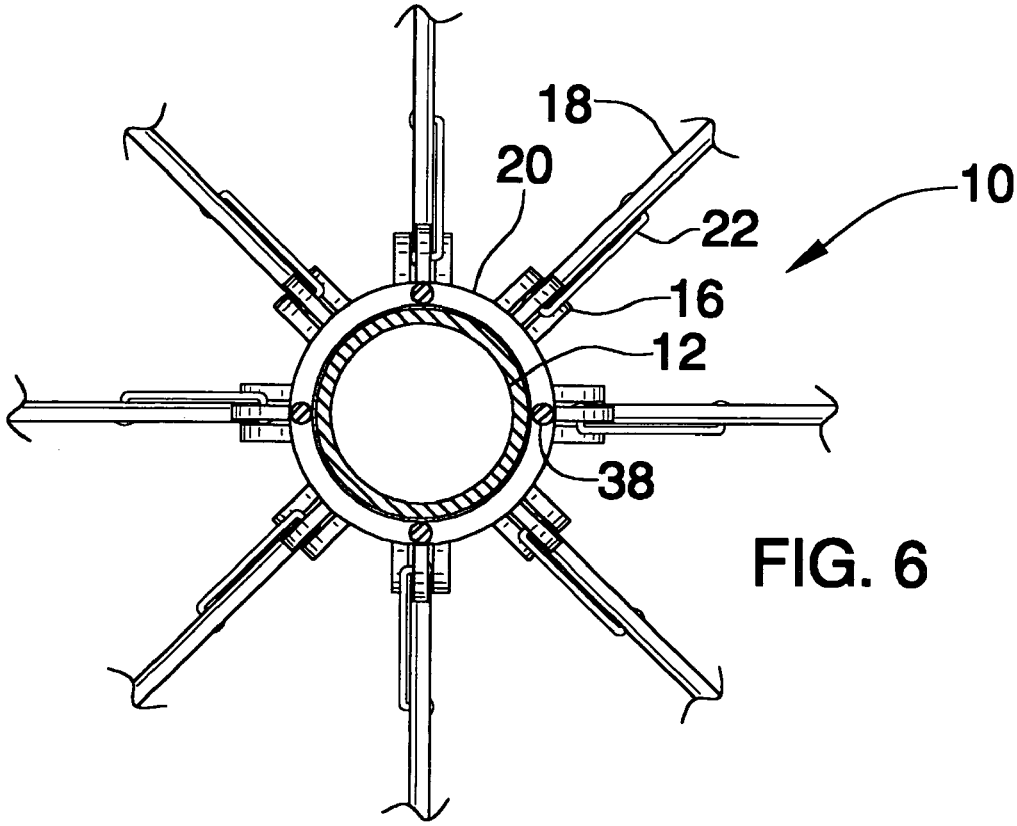
FIG. 6 is a section 6-6 view of FIG. 2 of the collapsible artificial Christmas tree of the present embodiment of the invention.

In FIG. 6, the collapsible artificial Christmas tree 10 is illustrated and will be described. More particularly, the collapsible artificial Christmas tree 10 has the elongate trunk 12. The branch hinge 16 is connected to the trunk 12. The slide ring 20 is slidably connected to the trunk 12. The branch lift rod 22 is rotatably connected to the slide ring 20. The branch lift rod 22 is rotatably connected to the tree branch 18 for moving the tree branch 18 when the slide ring 20 slidably moves on the trunk 12. The connecting rod 38 is connected to the slide ring 20.

While a preferred embodiment of the collapsible artificial Christmas tree has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable sturdy material such as wood or plastic may be used instead of the aluminum branches described. Also, the stem may also be made of heavy-duty wood, plastic, or similar material. Additionally the tree may include fiberoptic lights and have a musical chip.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

I claim:

1. A collapsible artificial Christmas tree comprising:

an elongate trunk having a top and a bottom;

a plurality of branch hinges connected to said trunk;

a tree branch rotatably connected to each of said branch hinges;

a plurality of slide rings slidably connected to said trunk, wherein said slide ring closest to said bottom of said trunk is a lowermost slide ring; and a plurality of branch lift rods rotatably connected to each of said slide rings, said branch lift rods rotatably connected to said tree branches for moving said tree branches when said slide rings slidably moves on said trunk.

2. The collapsible artificial Christmas tree of claim 1 further comprising:

a trunk base connected to said trunk.

3. The collapsible artificial Christmas tree of claim 2 further comprising:

a tree stand having a tree stand bore which is complementary to said trunk base.

4. The collapsible artificial Christmas tree of claim 2 wherein:

said trunk having a trunk locking hole therethrough; and said trunk base having a trunk base locking hole therethrough.

5. The collapsible artificial Christmas tree of claim 4 further comprising:

a locking pin disposable within said trunk locking hole, said locking pin disposable within said trunk base locking hole.

6. The collapsible artificial Christmas tree of claim 2 further comprising:

a spring connected to said bottom of said trunk and inserted into said trunk base.

7. The collapsible artificial Christmas tree of claim 1 further comprising:

a handle connected to said lowermost slide ring.

8. The collapsible artificial Christmas tree of claim 1 further comprising:

a plurality of connecting rods connected to said slide rings.

9. The collapsible artificial Christmas tree of claim 1 wherein:

said trunk is tubular.

10. The collapsible artificial Christmas tree of claim 1 wherein:

said tree branches are substantially shaped as an evergreen tree branch.

11. A collapsible artificial Christmas tree comprising:

an elongate trunk having a top and a bottom;

a plurality of branch hinges connected to said trunk;

a tree branch rotatably connected to each of said branch hinges;

a plurality of slide rings slidably connected to said trunk, wherein said slide ring closest to said bottom of said trunk is a lowermost slide ring;

a plurality of branch lift rods rotatably connected to said slide rings, said branch lift rods rotatably connected to said tree branch branches for moving said tree branches when said slide rings slidably moves on said trunk; and a trunk base connected to said trunk.

12. The collapsible artificial Christmas tree of claim 11 further comprising:

a tree stand having a tree stand bore which is complementary to said trunk base.

13. The collapsible artificial Christmas tree of claim 12 wherein:

said trunk having a trunk locking hole therethrough; and said trunk base having a trunk base locking hole therethrough.

14. The collapsible artificial Christmas tree of claim 13 further comprising:

a locking pin disposable within said trunk locking hole, said locking pin disposable within said trunk base locking hole.

15. The collapsible artificial Christmas tree of claim 14 further comprising:

a spring connected to said bottom of said trunk and inserted into said trunk base.

16. The collapsible artificial Christmas tree of claim 15 further comprising:

a handle connected to said lowermost slide ring.

17. The collapsible artificial Christmas tree of claim 16 further comprising:

a plurality of connecting rods connected to said slide rings.

18. The collapsible artificial Christmas tree of claim 17 wherein:

said trunk is tubular.

19. The collapsible artificial Christmas tree of claim 18 wherein:

said tree branches are substantially shaped as an evergreen tree branch.

20. A collapsible artificial Christmas tree comprising:

an elongate trunk having a bottom and a top, said bottom of said trunk having a trunk locking hole therethrough, said trunk is tubular, a plurality of branch hinges connected to said trunk;

a tree branch rotatably connected to each of said branch hinges, said tree branches are substantially shaped as an evergreen tree branch;

a plurality of slide rings slidably connected to said trunk, wherein said slide ring closest to said bottom of said trunk is a lowermost slide ring;

a plurality of branch lift rods rotatably connected to said slide rings, said branch lift rods rotatably connected to said tree branches for moving said tree branches when said slide rings slidably moves on said trunk;

a trunk base connected to said bottom of said trunk, said trunk base having a trunk base locking hole therethrough;

a tree stand having a tree stand bore which is complementary to said trunk base;

a locking pin disposable within said trunk locking hole, said locking pin disposable within said trunk base locking hole;

a spring connected to said bottom of said trunk and inserted into said trunk base;

a handle connected to said lowermost slide ring; and a plurality of connecting rods connected to said slide rings.

* * * * *